US008129670B2

(12) United States Patent
Laycock et al.

(10) Patent No.: US 8,129,670 B2
(45) Date of Patent: Mar. 6, 2012

(54) OPTICAL VECTOR MATRIX MULTIPLIERS

(75) Inventors: Leslie Charles Laycock, Ongar (GB); Vincent Andrei Henderek, Grays (GB)

(73) Assignee: BAE Systems PLC, London (GB)

( * ) Notice: Subject to any disclaimer, the term of this patent is extended or adjusted under 35 U.S.C. 154(b) by 28 days.

(21) Appl. No.: 12/087,578

(22) PCT Filed: Jun. 11, 2011

(86) PCT No.: PCT/GB2008/050430

§ 371 (c)(1),
(2), (4) Date: Jul. 10, 2008

(87) PCT Pub. No.: WO2009/007741

PCT Pub. Date: Jan. 15, 2009

(65) Prior Publication Data

US 2010/0165432 A1 Jul. 1, 2010

(30) Foreign Application Priority Data

Jul. 9, 2007 (EP) ..... 07270037
Jul. 9, 2007 (GB) ..... 0713246.7

(51) Int. Cl.
*G06E 1/04* (2006.01)

(52) U.S. Cl. ..... 250/208.1; 359/107

(58) Field of Classification Search ..... 250/208.1; 359/107

See application file for complete search history.

(56) References Cited

U.S. PATENT DOCUMENTS 4,849,940 A 7/1989 Marks, II et al.
(Continued)

FOREIGN PATENT DOCUMENTS

WO WO 01/72037 A1 9/2001
(Continued)

OTHER PUBLICATIONS

Dammann et al.,"High-Efficiency In-Line Multiple Imaging by Means of Multiple Phase Holograms" Optics Communications, 1971, vol. 3, No. 5, pp. 312-315, XP-002464558.

(Continued)

*Primary Examiner* — Seung C Sohn
(74) *Attorney, Agent, or Firm* — Buchanan Ingersoll & Rooney PC

(57) ABSTRACT

Improved optical vector matrix multipliers are disclosed. The multipliers comprise: a plurality of light sources, each operable to radiate light of intensity $u_i$; fan-out optics arranged to expand the light radiated by the light sources in one dimension; a spatial light modulator comprising a plurality of light modulating zones, each zone receiving light from one of the light sources and being operable to modulate the intensity of said received light by a factor of $v_{ij}$; and fan-in optics arranged to focus the modulated light onto a plurality of light detectors. The fan out optics, spatial light modulator, and fan-in optics are arranged such that an intensity of light proportional to $$\sum_i u_i v_{ij}$$

is received at each light detector; and the fan-out optics comprise guided-wave optical components. Specific embodiments are disclosed in which the fanout optics comprise optical splitters, or a partially guiding wedge prism.

7 Claims, 2 Drawing Sheets

U.S. PATENT DOCUMENTS

| | | | | |
|---|---|---|---|---|
| 5,448,749 | A | 9/1995 | Kyuma et al. | |
| 5,455,882 | A | 10/1995 | Veligdan | |
| 7,194,139 | B1 | 3/2007 | Sariel et al. | |
| 7,231,094 | B2 * | 6/2007 | Bickford et al. | 382/248 |
| 7,515,753 | B2 * | 4/2009 | Goldenberg et al. | 382/191 |
| 2004/0013341 | A1 | 1/2004 | Hall | |
| 2005/0018295 | A1 | 1/2005 | Mendlovic et al. | |

FOREIGN PATENT DOCUMENTS

| | | | |
|---|---|---|---|
| WO | WO 01/84262 | | 11/2001 |
| WO | WO 03/021373 | | 3/2003 |
| WO | WO 2006/082444 | A2 | 8/2006 |

OTHER PUBLICATIONS

Feitelson, "Optical Computing: A Survey for Computer Scientists" 1988, pp. 117-119 and 230, Mit Press, USA, XP002454641.

Feng et al., "Multiobject Recognition in a Multichannel Joint-Transform Correlator" Optics Letters, 1995, vol. 20, No. 1, pp. 82-84, XP002464557.

Gheen, "Optical Matrix-Matrix Multiplier" Applied Optics, 1990, vol. 29, No. 7, pp. 886-887.

Gibor, "Optical Processing: From Labs to Real Life, Practical Solutions to Accuracy Limitations" Confidential and Proprietary Information of Lenslet, 2004, Italy, pp. 1-20.

Goodman et al., "Fully Parallel, High-Speed Incoherent Optical Method for Performing Discrete Fourier Transforms" Optics Letters, 1978, vol. 2, No. 1, pp. 1-3.

Handerek et al., "Optical Testbed for Hybrid Optoelectronic Vector Matrix Processor for Radar Signal Processing" 3rd EMRS DTC Technical Conference-Edinburgh, 2006, B28( 5 pages).

Jahns, "Integrating the Optics into Optoelectronic Computing Systems" FernUniversität Hagen, Optische Nachrichtentechnik, IFC Workshop, 2002, pp. 1-30, Hagen, Germany.

Micaulay Alistair, "Optical Computer Architectures" 1991, pp. 92-93, John Wiley and Sons, New York, USA, XP002464559.

European Search Report in Application No. 07270037.0-1225 dated Jan. 25, 2008.

International Search Report and Written Opinion of the International Searching Authority in International Application No. PCT/GB2008/050430 dated Aug. 6, 2008.

Notification Concerning Transmittal of International Preliminary Report on Patentability (Forms PCT/IB/326 and PCT/IB/373) and the Written Opinion of the International Searching Authority (Form PCT/ISA/237) issued in corresponding International Application No. PCT/GB2008/050430 dated Jan. 21, 2010.

United Kingdom Search Report.

* cited by examiner

OPTICAL VECTOR MATRIX MULTIPLIERS

The present invention relates to optical vector matrix multipliers. In particular, the present invention is concerned with constructions of optical vector matrix multipliers that enable a reduction in the size of such multipliers.

An optical method of calculating a vector matrix product is described in the paper "Fully parallel, high speed incoherent optical method for performing discrete Fourier transforms" by Goodman, Dias and Woody, published in Optics Letters Volume 2 pages 1-3 (1978). A schematic diagram illustrating a multiplier 100 that works on the principles set out by Goodman et al. is shown in FIG. 1. An input vector u having n elements $u_1, u_2, \ldots u_i, \ldots u_n$ is represented by an array of n light sources 110 each emitting an intensity representative of one element of vector u. The light emitted by each of the light sources in array 100 is expanded in the vertical plane, as shown in the diagram, to illuminate a columnar zone of spatial light modulator 130. The optics necessary to fan-out the beam in this manner are not illustrated in FIG. 1. Spatial light modulator 130 comprises a number n×n light modulating zones, such as zone 135 indicated in FIG. 1, each of which is operable to modulate the intensity of light falling thereon by a factor $v_{ij}$. The factors $v_{ij}$ in combination represent the matrix v multiplying the input vector. The indices i, j therefore represent both the position (row, column) of the element in the matrix and the position of the respective light modulating zone in the spatial light modulator 130. Light transmitted through the modulator is then focussed in the horizontal plane, as shown in FIG. 1, onto an array of light detectors 150. Again, the optical elements necessary to fan-in the beams from the various light modulating zones are not shown in FIG. 1. Thus the light intensity transmitted through each row of modulating zones in the spatial light modulator 130 is summed onto one of the light detectors in the array 150.

In this way, it can be seen that the light intensity received at the array of detectors is representative of the multiplication u×v in accordance with:

$$(u_1\ u_2\ \ldots\ u_n)\begin{pmatrix} v_{11} & v_{12} & \cdots & v_{1n} \\ v_{21} & v_{22} & & \\ \vdots & & \ddots & \\ v_{n1} & & & v_{nn} \end{pmatrix} = (w_1\ w_2\ \ldots\ w_n)$$

where:

$$w_i = \sum_i u_i v_{ij},$$

and that the optical processor is therefore operable to calculate the vector matrix product, on application of suitable signals to the input array 100 and spatial light modulator 130. Such computation can be extremely fast in comparison to standard computation techniques using digital circuitry.

Despite the dramatic enhancements in processor speed possible with such processing techniques, there has to date been limited practical application of these techniques. To date, such processors have primarily been embodied using bulk optical components on laboratory optical test-beds, with little work being done to create practical processors suitable for large-scale manufacture. One such system is disclosed in the paper "Optical Testbed for Hybrid Optoelectronic Vector Matrix Processor for Radar Signal Processing" by Handerek, Kent, McCarthy and Laycock, published in the Proceedings of the 3rd EMRS DTC Technical Conference (2006). This system is illustrated schematically in FIG. 2. Apparatus 200 comprises a source array 210 of sixteen vertical cavity surface emitting lasers (VCSELs), spatial light modulator 230, and detector array 250. The VCSELs are of 5 μm diameter, and are on a 62.5 μm pitch. A rectangular aperture (not shown) is used to limit the numerical aperture of the source array to 0.2. The spatial light modulator 250 is a reflective modulator, rather than a transmissive modulator as is illustrated in FIG. 1. The use of a reflective modulator offers several advantages, including that of mitigating the problem of location for driving circuitry for the modulator. Since the modulator is polarisation sensitive, a polarising beam splitter 270 is used to split the beam into a component directed to the modulator, and a component returning from the modulator that is reflected to the detector array 250. In practice, the apparatus 200 is 37 cm long (from the light sources 210 to the spatial light modulator 230) and 9.5 cm wide.

International Patent Application, Publication No. WO 03/021373 in the name of Lenslet Ltd discloses a number of similar bulk-optics arrangements suitable for a vector matrix processor. These processors again use cylindrical lenses to accomplish fan-out of radiation from a light source array, and to accomplish fan-in of light reflected from a spatial light modulator.

Alternative arrangements, disclosed in International Patent Application, Publication No. WO 01/84262 in the name of JTC 2000 Development (Delaware) Inc., make use of perpendicular arrays of light pipes having transmissive windows and being separated by a spatial light modulator. However, the Applicant is not aware of any significant commercial use of such arrangements. It is thought that an inherent design problem exists, since light travelling in the light pipes to the detector array may also 'leak' back into the light source light pipes, resulting in large losses.

In light of the above, it can be seen that there exists a need for further development of optical processors so as to realise a practicable implementation of such a processor. Prior-known optical processors are bulky, and prone to problems arising from aberration in optical components, or, where the need for more compact processors has been recognised, to inherent design problems. It is therefore an aim of the present invention to overcome, or at least partially mitigate, some of the above problems.

In accordance with a first aspect of the present invention, there is provided an optical vector matrix multiplier comprising:

- a plurality of light sources, each operable to radiate light of intensity $u_i$;
- fan-out optics arranged to expand the light radiated by the light sources in one dimension;
- a spatial light modulator comprising a plurality of light modulating zones, each zone receiving light from one of the light sources and being operable to modulate the intensity of said received light by a factor of $v_{ij}$; and
- fan-in optics arranged to focus the modulated light onto a plurality of light detectors;

the fan out optics, spatial light modulator, and fan-in optics being arranged such that an intensity of light proportional to $$\sum_i u_i v_{ij}$$

is received at each light detector; and wherein the fan-out optics comprise guided-wave optical components. The use of guided wave components allows the size of the optical vector matrix multiplier to be reduced, and mitigates the problems associated with optical aberration in more traditional bulk optical components, thereby increasing the accuracy of the optical vector matrix multiplier. Herein, it is to be understood that the term "guided wave components" refers to those optical components that use total internal reflection to guide light.

Optionally, in accordance with one embodiment of the invention, the fan-out optics comprise a partially-guiding wedge plate. Embodiments in which a partially-guiding wedge prism is used as a part of the fan-out optics can be made to have a substantially flat aspect, thus facilitating packaging of the optical vector matrix multiplier. For example, a box-like package can be more easily achieved. Such a package can be more easily placed into typical equipment spaces. Furthermore, the presence of a substantially flat aspect facilitates heat dissipation, electrical connections, robustness of the optical alignment, and sealing from intrusion of dust and other foreign bodies. The fan-out optics may further comprise an anamorphic beam expander, such as, for example, a cylindrical lens, positioned between the partially-guiding wedge plate and the plurality of light sources. Such a supplementary beam expander may be needed should the wedge prism not be sufficient to expand the light to fully illuminate the spatial light modulator.

Preferably, light radiated from the light sources is collimated prior to entering the fan-out optics.

The spatial light modulator may be configured to receive light from the partially-guiding wedge plate, and to reflect light back into the partially-guiding wedge plate. The spatial light modulator and the partially guiding-wedge plate may be configured such that light reflected back into the partially guiding wedge plate traverses the plate and exits the plate to be received by the fan-in optics. Such a geometry has been found to result in the simplest overall construction of the optical vector matrix multiplier. The fan-in optics may comprise a cylindrical lens, or other suitable anamorphic optical components.

In a further embodiment of the invention, the fan-out optics comprise a plurality of splitters each arranged to receive light from one of the light sources, and to split said received light into j components to be received by the spatial light modulator. Each splitter may be configured to split said received light into j components of substantially equal intensity. The use of splitters enables the overall size of the optical vector matrix multiplier to be reduced in comparison to prior-known such multipliers. Moreover, the potential for error arising from aberration is reduced, since the use of splitters substantially eliminates aberrations from the fan-out part of the optical processor. The splitters may be formed as an integrated stack. This further reduces the size of the optical vector matrix multiplier and eliminates the need to separately align each of the splitters. The optical vector matrix multiplier may further comprise a microlens array provided between the plurality of splitters and the spatial light modulator, and configured to frame each of the j components on to one of the light modulating zones of the spatial modulator. Moreover, to further reduce the size of the optical vector matrix multiplier, at least a part of the fan-in optics may be located prior to the spatial light modulator.

The plurality of light sources may comprise a plurality of vertical cavity surface emitting lasers. Such sources are widely available, and can therefore be used conveniently and at low cost.

Preferred embodiments of the invention will now be described by way of example only and with reference to the accompanying drawings, in which.

Figure 1:
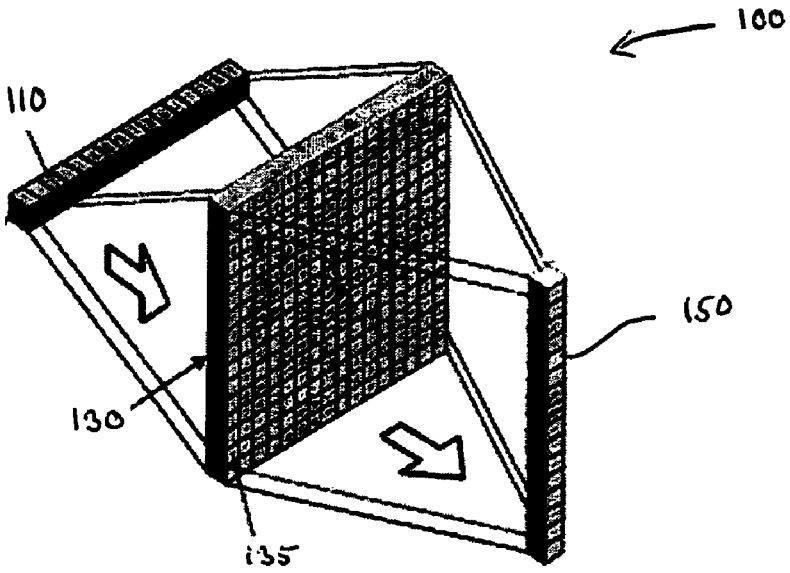
Figure 1 (Prior art)
FIG. 1 is a schematic drawing illustrating how an optical processor can be used to calculate a vector matrix product.
Figure 2:
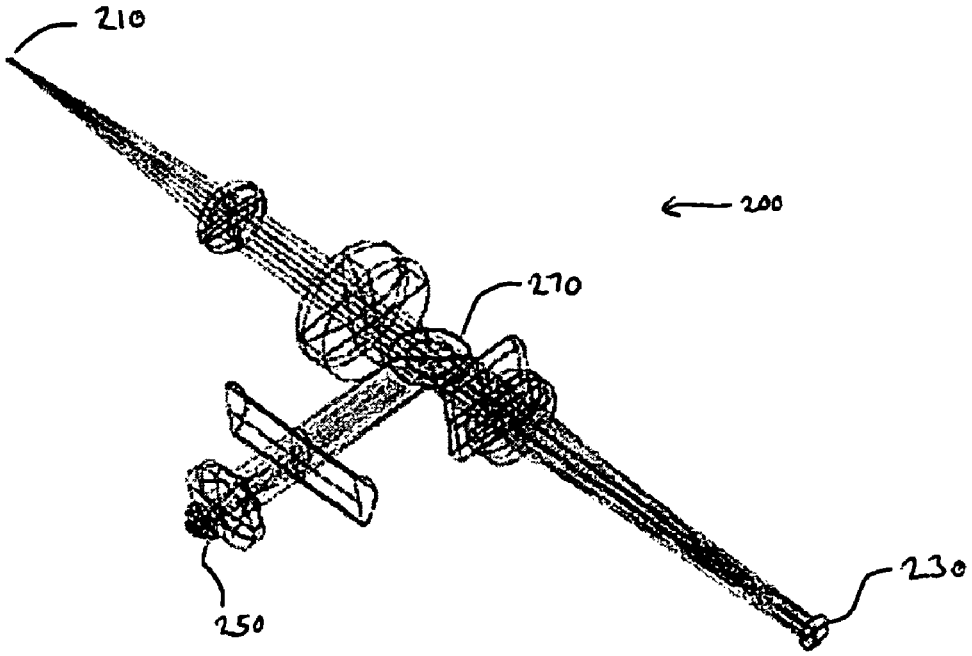
Figure 2 (Prior art)
FIG. 2 is a schematic diagram of a prior art optical vector matrix multiplier.

The embodiments of the invention to be described below implement the general optical vector matrix multiplier scheme illustrated in FIG. 1. The way in which the input vector and matrix are represented, and the way in which the product is calculated, are the same as those described in the above. A series of independent light sources are used to emit light having intensities representative of the elements of an input vector. The light sources are arranged linearly. Fan-out optics are used to broaden the beams emitted from the light source in the plane perpendicular to the linear arrangement of light sources, and the fanned-out beams are incident on a spatial light modulator. In the embodiments described below, the spatial light modulator is reflective, and comprises a number of light modulating zones arranged in a grid-like pattern. Each light source illuminates a column of light modulating zones. Each light modulating zone modulates the intensity of received light by a proportion related to an element of the matrix. Fan-in optics are then used to focus light reflected from the spatial light modulator onto a detector array, such that each detector element receives light from each light modulating zone in a row of the spatial light modulator. In this way, the intensity of light received at the detector is related to the product of the vector and the matrix, as has been described above in relation to FIG. 1.

As those skilled in the art will appreciate from the foregoing description the term "optical vector matrix multiplier" is used herein to mean any processor operable to multiply a matrix and a vector that uses optical components to perform a multiplication operation, and hence includes, for example, processors that use electronic means to control the intensities of light emitted by an array of light sources, and the degree of modulation applied by a spatial light modulator.

Figure 3:
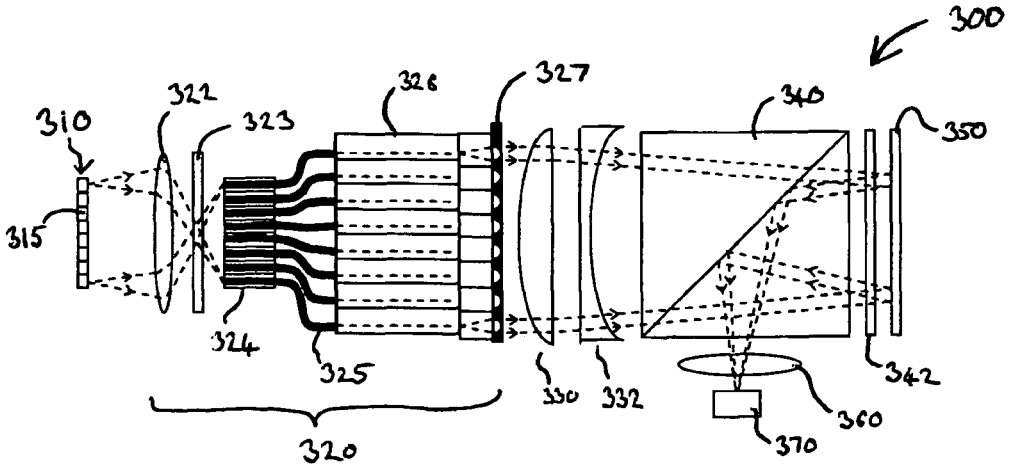
FIG. 3 is a schematic diagram of an optical vector matrix multiplier in accordance with a first embodiment of the invention.

An optical vector matrix multiplier 300 in accordance with a first embodiment of the invention is illustrated in FIG. 3. An array of light sources 310 comprises eight vertical cavity surface emitting lasers (VCSELs), such as that labelled 315, at 62.5 μm pitch. The VCSELs chosen for the present embodiment emit light at a wavelength of 835 nm. They are selected because their output can be modulated rapidly so that the speed of the multiplier is enhanced. They are also readily available off-the-shelf components.

Light from the VCSEL array 310 enters the fan-out optics 320, which spread the light from each of the VCSELs in the array 310 in the plane perpendicular to that of the plan drawing of FIG. 3. Specifically, the light emitted by the array 310 is focussed by lens 322 onto a set of eight optical fibres 325. The light passes through half-wave plate 323 between the imaging lens 322 and the optical fibres 325 that rotates the polarisation of the light emitted by the VCSEL array appropriately for the polarisation sensitive spatial light modulator 350, that is described in further detail hereinafter. The fibres are held, at the end closest to the VCSEL array 310, in a 10 mm long V-groove array 324 on a 127 μm pitch which serves to keep the fibres in place in the focal plane of lens 322. The optical fibres are selected to be of a type that maintains the polarisation of the light that they transmit.

Optical fibres 325 lead to a stack of eight waveguide splitters 326. The splitters 326 used for the present embodiment are single mode polarisation-maintaining splitters configured for operation at 835 nm, and were obtained from the manufacturer IOTech GmbH, Wagheusel, Germany. As those skilled in the art will appreciate, the dimensions of the splitters are configured such that the output beams are correctly positioned for the spatial light modulator and fan-in optics described below. Each splitter receives a beam of light from one of the array of VCSELs and splits it into eight component beams of equal intensity. These eight beams are distributed in the plane perpendicular to that of the VCSEL array—i.e. they are distributed perpendicularly to the plane of the Figure. A total of sixty-four beams are therefore emitted from the output end of splitters 326.

Light leaving the splitters 326 is collimated by an array of microlenses 327. In the present embodiment, there are sixty-four microlenses to collimate each of the beams emitted from the stack of waveguide splitters 326. The array of microlenses can be fabricated as a monolithic two dimensional array. Such arrays are commercially available, for example from Adaptive Optics Associates Inc. of Cambridge, Mass., USA. The microlenses used in the present embodiment have a focal length of 0.83 mm and are spaced on a pitch of 250 μm. The array of microlenses, splitters and fan-in optics are arranged so that only the active areas of the spatial light modulator 350 are illuminated. The array of microlenses is further arranged such that the waist of each of the beams is located at the spatial light modulator.

The collimated beams emanating from the array of microlenses 327 are incident on cylindrical lenses 330, 332 that form a part of the fan-in optics. Lenses 330, 332 are, respectively, a converging lens and a diverging lens, that in combination form a telephoto arrangement that reduces the widths of the beams in the plane of the drawing. Use of lenses 330, 332 in combination as a telephoto arrangement enables the size of the multiplier 300 to be further reduced. Notably, the plane of the drawing is perpendicular to the plane in which the splitter array 326 fans out the beams from the VCSEL array 310. It can therefore be seen that the fan-in optics are located prior to the spatial light modulator 350. Such an arrangement has been found to be preferable for the purposes of ensuring a small overall size for the multiplier 300. Subsequent to passing through lenses 330, 332, the beams pass through a polarisation beamsplitter cube 340 and a quarter-wave plate 342 to reach the spatial light modulator 350.

The spatial light modulator 350 operates in reflective mode and comprises a number of light modulating zones that are operable to modulate the polarisation of the light beams reflected therefrom. Liquid crystal modulators that alter the polarisation state of incident light are widely available, relatively insensitive to the wavelength of the incident light, and commonly used in display type applications. Liquid crystal modulators suitable for the processing applications can be obtained from, for example, Forth Dimension Displays of Dalgety Bay, Scotland, UK. In the present embodiment, the spatial light modulator comprises sixty-four light modulating zones, one zone for each of the beams emitted from the microlens array 327. Light of modulated polarisation is reflected from the spatial light modulator 350 to pass once more through the quarter-wave plate. Thus the total rotation of the polarisation of the light between leaving and re-entering the polarisation beamsplitter cube 340 is 90°, as a result of passing twice through the quarter-wave plate 342, in addition to whatever polarisation change is incurred as a result of modulation by the spatial light modulator 350.

At the diagonal plane of the beamsplitter cube 340, modulated light is partially reflected towards a fast detector array 370. Only that part of the modulated light with a linear state of polarisation perpendicular to incident light is reflected at this plane. Thus the combination of the beamsplitter cube 340, quarter-wave plate 342 and spatial light modulator 350 effect a modulation of the intensity of light reaching the fast detector array 370, with the degree of modulation of polarisation effected at the spatial light modulator controlling the actual light intensity reaching the detector array 370. As will be appreciated, after appropriate calibration, the intensity of light falling on the fast detector array 370 is representative of a vector matrix product as described above. Calibration can be used both to account for losses in the optical system as well as to determine the amount of polarisation modulation necessary to ensure that the various light modulating zones of the spatial light modulator 350 correctly represent the matrix v, and to relate the intensity of light falling on the fast detector array 370 to the desired vector-matrix product.

Optical vector matrix multiplier 300 can be made significantly smaller than previous such multipliers because of the use of guided wave components (optical fibres 325 and splitters 326), and the use of micro-optics (microlens array 327). The multiplier 300 is more practical than prior known such multipliers as a result of its miniaturisation, but, moreover, the use of guided wave components and micro-optics mitigates problems associated with aberrations in bulk optical components.

Figure 4A:
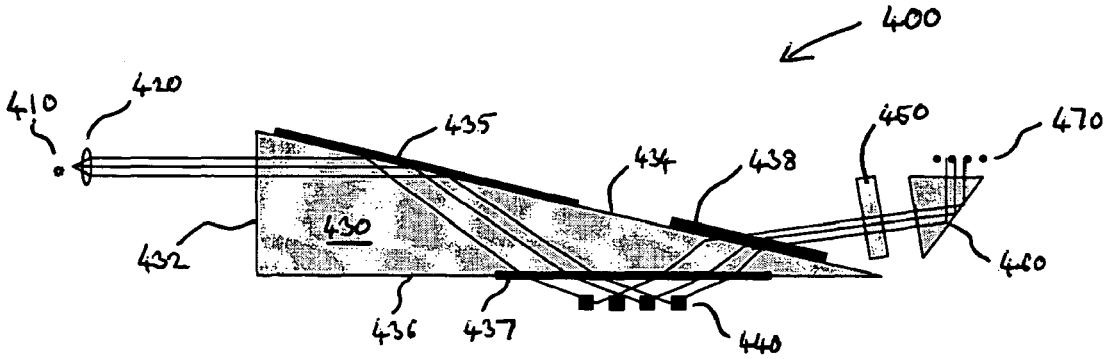
FIGS. 4*a* and 4*b* are schematic diagrams of an optical vector matrix multiplier in accordance with second and third embodiments of the invention.

An optical vector matrix multiplier 400 in accordance with a second embodiment of the invention is shown in FIG. 4*a*. The multiplier 400 comprises a light source array 410 that is an array of VCSELs as in the first embodiment. 300 described above. The VCSELs of the array 410 form a strip extending out of the plane of FIG. 4. A microlens array 420 is used to collimate the light emitted by the VCSEL array. In the present embodiment, the focal length of each microlens in the array is 0.83 mm, and the lenses are placed one focal length away from the VCSEL array. As described above, such arrays are commercially available, for example from Adaptive Optics Associates Inc.

Figure 4B:
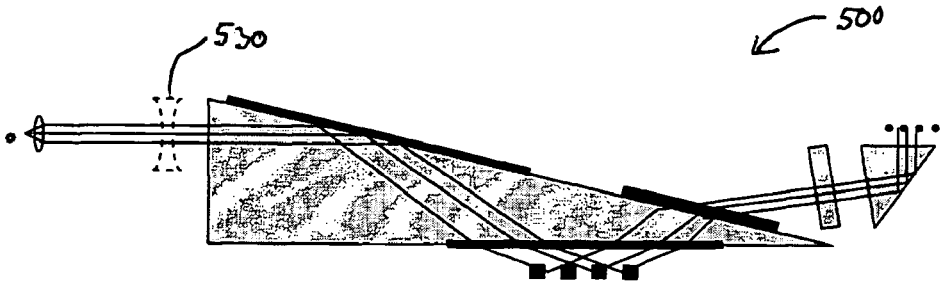

The collimated beams enter into a partially guiding wedge prism 430. The wedge prism, as shown, has a fat end 432 on which the collimated beams are normally incident, an upper sloping surface 434, and a lower horizontal surface 436. The wedge is used to fan-out the light beams from each of the VCSELs in the array 410, acting similarly to a prism beam expander. As is shown in FIG. 4, after passing into the wedge each beam is subject to total internal reflection at the sloping surface 434 of the prism. A coating 435 is applied to the sloping surface of the prism at the region where total internal reflection occurs. The coating 435 serves to enhance the reflectance of the surface, thereby reducing unwanted losses due to transmittal of light through the surface, and also protects the surface of prism from damage, thereby preventing further unwanted losses due to surface aberration.

The beams exit the wedge prism on the horizontal, lower (as shown in FIG. 4) edge 436 of the prism. The geometry of the prism is selected such that each beam exits the prism in an extended, stripe-shaped region. An anti-reflection coating 437 is applied to surface 436 in the region where the beams exit, so as to protect the surface, and so as to avoid losses due to unwanted reflections. The beams are refracted at the surface 436 so as to be incident on a spatial light modulator 440. The spatial light modulator 440 in the second embodiment 400 is a multi-quantum-well type arranged to directly modulate the intensity of the light it reflects. Such modulators are less widely available than liquid crystal modulators, and are more sensitive to the wavelength of incident light. However, the use of such a modulator has the advantages that the overall construction of the processor 400 is simplified because the need for polarisation analysers to change light intensity is obviated, and provide very fast modulation rates—of the order of several GHz. In contrast, liquid crystal modulators are limited to modulation rates of the order of tens of kHz. The beams incident on the spatial light modulator 440 are arranged, by selection of the geometry of the wedge prism 430, to be sufficiently wide, in the plane of the spatial light modulator 440, to illuminate the whole spatial light modulator 440, with each beam illuminating one column of spatial light modulating zones. Thus in the present embodiment, fan-out of the beams is accomplished by the partially guiding wedge prism.

The modulated intensity beams reflected from the spatial light modulator pass back into the wedge prism 430. Anti-reflective coating 437 extends to the region in which the beams re-enter the wedge, again protecting the surface in this area and mitigating the effects of unwanted reflection. The beams traverse the thin end of the wedge 430, exiting in a region on the upper sloping surface 436 where a further anti-reflection coating 438 is applied. A cylindrical lens 450 is used to fan-in the beams in the plane perpendicular to the Figure, and to focus the beams onto a fast detector array 470 in a manner similar to that described above in relation to the first embodiment. Multiplier 400 further comprises a turning prism 460 arranged such that the detector array can be aligned parallel to the spatial light modulator. With such an alignment, the overall optical processor presents a substantially flat aspect that is preferable for the purposes of packaging of the multiplier 400.

As will be appreciated from the foregoing description, the intensities received at the detector array 470 will be related to the elements of a vector that is the product of a vector represented by the array of light sources 410, and the matrix represented by spatial light modulator 440. Appropriate calibration of the processor 400 enables it to be used as a vector matrix multiplier.

The optical vector matrix multiplier 400 of the second embodiment has the advantage, in comparison to multiplier 300 of the first embodiment, of providing a substantially flat aspect, resulting in easier packaging. Moreover, construction of the second embodiment is made simpler and cheaper as a result of the use of a wedge prism in the fan-out optics. However, multiplier 300 has the advantage that losses of light are reduced through use of the splitters in the fan-out optics, which can be used to ensure that only active parts of the spatial light modulator are illuminated, rather than illuminating the entire modulator, including any 'dead' zones between the various light modulating zones, as occurs in the multiplier 400 of the second embodiment.

FIG. 5 shows an optical vector matrix multiplier 500 in accordance with a third embodiment of the invention. Embodiment 500 is similar to embodiment 400 except in that an additional cylindrical lens 530 is incorporated between the partially-guiding wedge prism and the array of microlenses that collimate each of the beams from the array of VCSELs. Additional lens 530 is used where the wedge prism alone is not sufficient to expand the beams to fully illuminate the spatial light modulator. As those skilled in the art will appreciate, other anamorphic beam expanders could be used in place of a simple cylindrical lens.

Having described the various specific embodiments of the invention, it is to be noted that these embodiments are purely examples, and that modifications to the embodiments are possible without departing from the scope of the invention, which is defined in the accompanying claims. Such modifications will be obvious to those skilled in the art. For example, whilst, in relation to the first embodiment 300 (shown in FIG. 3) it has been described to use eight separate waveguide splitters, the skilled reader will realise that the stack of splitters can be formed as a monolithic stack in order to enhance the level of miniaturisation possible for the first embodiment 300 and to obviate the need to separately align each of the plurality of splitters. Furthermore, and again in relation to the second embodiment described above, the skilled reader will clearly understand that it would also be possible to use a polarisation modulating spatial light modulator, rather than a spatial light modulator that directly modulates light intensity, should this be considered more convenient for a particular application. As will be readily understood, the use of such a spatial light modulator will require the incorporation of additional polarising components, as described in relation to the first embodiment, in order to accomplish appropriate intensity modulation.

Finally, it is noted that it is to be clearly understood that any feature described above in relation to any one embodiment may be used alone, or in combination with other features described, and may also be used in combination with one or more features of any other of the embodiments, or any combination of any other of the embodiments.

The invention claimed is:

1. An optical vector matrix multiplier comprising:

a plurality of light sources, each operable to radiate light of intensity $u_i$;

fan-out optics arranged to expand the light radiated by the light sources in one dimension;

a spatial light modulator comprising a plurality of light modulating zones, each zone receiving light from one of the light sources and being operable to modulate the intensity of said received light by a factor of $v_{ij}$; and fan-in optics arranged to focus the modulated light onto a plurality of light detectors wherein the fan out optics, spatial light modulator, and fan-in optics are arranged such that an intensity of light proportional to $$\sum_i u_i v_{ij}$$

is received at each light detector; and wherein the fan-out optics comprise guided-wave optical components, and wherein the fan-out optics comprise a partially-guiding wedge plate.

2. The optical vector matrix multiplier as claimed in claim 1, wherein the fan-out optics further comprise an anamorphic beam expander positioned between the partially-guiding wedge plate and the plurality of light sources.

3. The optical vector matrix multiplier as claimed in claim 1, wherein light radiated from the light sources is collimated prior to entering the fan-out optics.

4. The optical vector matrix multiplier as claimed in claim 1, wherein the spatial light modulator is configured to receive light from the partially-guiding wedge plate, and to reflect light back into the partially-guiding wedge plate.

5. The optical vector matrix multiplier as claimed in claim 4, wherein the spatial light modulator and the partially guiding-wedge plate are configured such that light reflected back into the partially guiding wedge plate traverses the plate and exits the plate to be received by the fan-in optics.

6. The optical vector matrix multiplier as claimed in claim 1, wherein the fan-in optics comprise a cylindrical lens.

7. The optical vector matrix multiplier as claimed in claim 1, wherein the plurality of light sources comprises a plurality of vertical cavity surface emitting lasers.

* * * * *